US008818255B2

(12) United States Patent
Yoshida et al.

(10) Patent No.: US 8,818,255 B2
(45) **Date of Patent: *Aug. 26, 2014**

(54) IMAGE FORMING APPARATUS WITH FIXING LIQUID APPLICATOR

(75) Inventors: Ryuji Yoshida, Kanagawa (JP); Nobuyuki Koinuma, Kanagawa (JP); Tomoko Takahashi, Kanagawa (JP); Mugijirou Uno, Kanagawa (JP); Mikio Ishibashi, Kanagawa (JP); Hideki Zemba, Kanagawa (JP); Yoshinori Nakagawa, Kanagawa (JP); Shunichi Hashimoto, Kanagawa (JP); Naoyuki Ozaki, Kanagawa (JP); Hideaki Kanaya, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 452 days.

This patent is subject to a terminal disclaimer.

(21) Appl. No.: 13/047,316

(22) Filed: Mar. 14, 2011

(65) Prior Publication Data

US 2011/0229179 A1 Sep. 22, 2011

(30) Foreign Application Priority Data

Mar. 17, 2010 (JP) ..... 2010-061655
Jul. 30, 2010 (JP) ..... 2010-172392

(51) Int. Cl.
*G03G 15/20* (2006.01)

(52) U.S. Cl.
USPC ..... 399/340

(58) Field of Classification Search
CPC G03G 15/2096; G03G 11/00; G03G 15/1695
USPC ..... 399/340, 296
See application file for complete search history.

(56) References Cited

U.S. PATENT DOCUMENTS 4,908,669 A * 3/1990 Yamamoto
4,975,748 A 12/1990 Koinuma et al.
5,003,354 A 3/1991 Takamiya et al.
5,016,114 A 5/1991 Sakata et al.

(Continued)

FOREIGN PATENT DOCUMENTS

JP 10-49654 2/1998
JP 11002985 A * 1/1999

(Continued)

OTHER PUBLICATIONS

U.S. Appl. No. 12/879,585, filed Sep. 10, 2010, Tomoko Takahashi et al.

(Continued)

*Primary Examiner* — Walter L Lindsay, Jr.
*Assistant Examiner* — Milton Gonzalez
(74) *Attorney, Agent, or Firm* — Oblon, Spivak, McClelland, Maier & Neustadt, L.L.P.

(57) ABSTRACT

An image forming apparatus including a fixing liquid applicator to apply a fixing liquid to a recording medium, a transfer device to transfer a toner image from a toner image bearing member onto the recording medium to which the fixing liquid is applied while the toner image is in contact with the fixing liquid, and a fixing device to fix the toner image on the recording medium by heating the toner image and the fixing liquid. The fixing liquid comprises a plasticizer having a function to swell and soften a toner.

12 Claims, 7 Drawing Sheets

(56) References Cited

U.S. PATENT DOCUMENTS

| | | | | |
|---|---|---|---|---|
| 5,051,760 | A | 9/1991 | Shoji et al. | |
| 5,105,284 | A | 4/1992 | Sakata et al. | |
| 5,270,783 | A | 12/1993 | Bisaiji et al. | |
| 5,337,075 | A | 8/1994 | Takahashi et al. | |
| 5,802,440 | A * | 9/1998 | Maeyama | |
| 5,911,814 | A * | 6/1999 | Kitazawa et al. | |
| 6,721,534 | B2 | 4/2004 | Takahashi | |
| 6,947,682 | B2 | 9/2005 | Kosugi et al. | |
| 7,110,917 | B2 | 9/2006 | Matsuura et al. | |
| 7,155,152 | B2 | 12/2006 | Iwai et al. | |
| 7,203,431 | B2 | 4/2007 | Shoji et al. | |
| 7,289,746 | B2 | 10/2007 | Yamada et al. | |
| 7,327,962 | B2 | 2/2008 | Shoji et al. | |
| 7,593,657 | B2 | 9/2009 | Takahashi et al. | |
| 7,672,604 | B2 | 3/2010 | Takahashi et al. | |
| 7,672,625 | B2 | 3/2010 | Takahashi et al. | |
| 7,734,233 | B2 | 6/2010 | Aoki et al. | |
| 7,783,235 | B2 | 8/2010 | Tsukamoto et al. | |
| 7,796,294 | B2 | 9/2010 | Sakai et al. | |
| 7,817,174 | B2 | 10/2010 | Saitoh et al. | |
| 7,817,953 | B2 | 10/2010 | Ishibashi et al. | |
| 7,865,121 | B2 | 1/2011 | Iwasaki et al. | |
| 7,869,723 | B2 | 1/2011 | Koinuma | |
| 7,883,089 | B2 | 2/2011 | Sudo et al. | |
| 2002/0085849 | A1 * | 7/2002 | Endo | |
| 2006/0088337 | A1 * | 4/2006 | Nakazato et al. | |
| 2007/0015071 | A1 | 1/2007 | Tsukamoto et al. | |
| 2007/0086811 | A1 | 4/2007 | Tsukamoto et al. | |
| 2007/0098469 | A1 * | 5/2007 | Yoshino et al. | 399/340 |
| 2007/0196146 | A1 * | 8/2007 | Tanaka et al. | 399/340 |
| 2008/0019708 | A1 | 1/2008 | Sakamaki et al. | |
| 2008/0025774 | A1 | 1/2008 | Ishibashi et al. | |
| 2008/0089723 | A1 | 4/2008 | Tsukamoto et al. | |
| 2008/0102392 | A1 | 5/2008 | Koinuma et al. | |
| 2008/0152407 | A1 | 6/2008 | Sudo et al. | |
| 2008/0185091 | A1 | 8/2008 | Sudo et al. | |
| 2008/0196832 | A1 | 8/2008 | Nakamura et al. | |
| 2008/0223515 | A1 | 9/2008 | Sudo et al. | |
| 2008/0225351 | A1 | 9/2008 | Sudo et al. | |
| 2008/0227019 | A1 | 9/2008 | Iwasaki et al. | |
| 2008/0286015 | A1 | 11/2008 | Kadota et al. | |
| 2009/0000445 | A1 | 1/2009 | Yamamoto et al. | |
| 2009/0016781 | A1 | 1/2009 | Takahashi et al. | |
| 2009/0022523 | A1 | 1/2009 | Kadota et al. | |
| 2009/0035025 | A1 | 2/2009 | Ishii et al. | |
| 2009/0044915 | A1 | 2/2009 | Mizutani et al. | |
| 2009/0067879 | A1 | 3/2009 | Takahashi et al. | |
| 2009/0067889 | A1 | 3/2009 | Nakagawa et al. | |
| 2009/0123193 | A1 | 5/2009 | Kosugi et al. | |
| 2009/0196638 | A1 | 8/2009 | Sukesako et al. | |
| 2009/0257786 | A1 | 10/2009 | Nakagawa et al. | |
| 2009/0257791 | A1 | 10/2009 | Nakagawa et al. | |
| 2009/0290901 | A1 | 11/2009 | Ishii et al. | |
| 2010/0021214 | A1 | 1/2010 | Kadota et al. | |
| 2010/0040393 | A1 | 2/2010 | Kawahara et al. | |
| 2010/0183342 | A1 | 7/2010 | Saitoh et al. | |
| 2010/0214364 | A1 | 8/2010 | Hirota et al. | |
| 2010/0278558 | A1 | 11/2010 | Enoki et al. | |
| 2011/0013950 | A1 | 1/2011 | Furuya et al. | |
| 2011/0043589 | A1 | 2/2011 | Hirota et al. | |
| 2011/0058832 | A1 | 3/2011 | Suzuki et al. | |

FOREIGN PATENT DOCUMENTS

| | | | |
|---|---|---|---|
| JP | 2000-11493 | | 1/2000 |
| JP | 2004333866 | A * | 11/2004 |
| JP | 2007-121652 | | 5/2007 |
| JP | 2007-163796 | | 6/2007 |
| JP | 2008-32675 | | 2/2008 |
| JP | 4224076 | | 11/2008 |
| JP | 2009-39976 | | 2/2009 |
| JP | 2009-39977 | | 2/2009 |
| JP | 4354164 | | 8/2009 |
| JP | 2010-32660 | | 2/2010 |

OTHER PUBLICATIONS

U.S. Appl. No. 12/881,822, filed Sep. 14, 2010, Ryuji Yoshida et al.

* cited by examiner

FIG. 6A
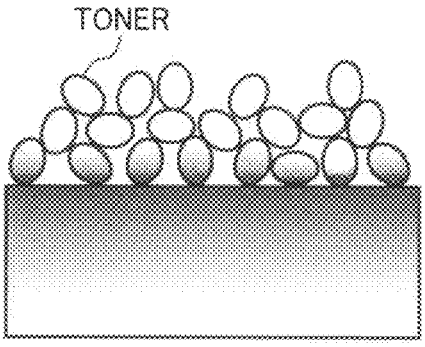
FIG. 6B
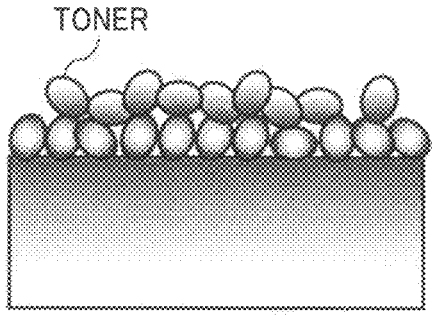
FIG. 7A
FIG. 7B
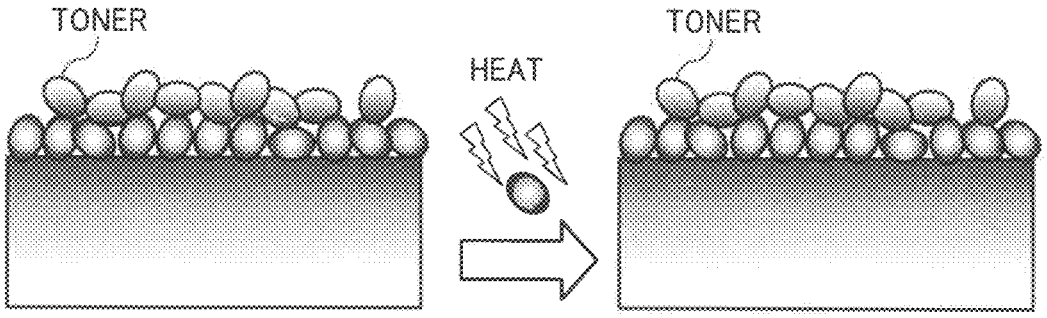
FIG. 8
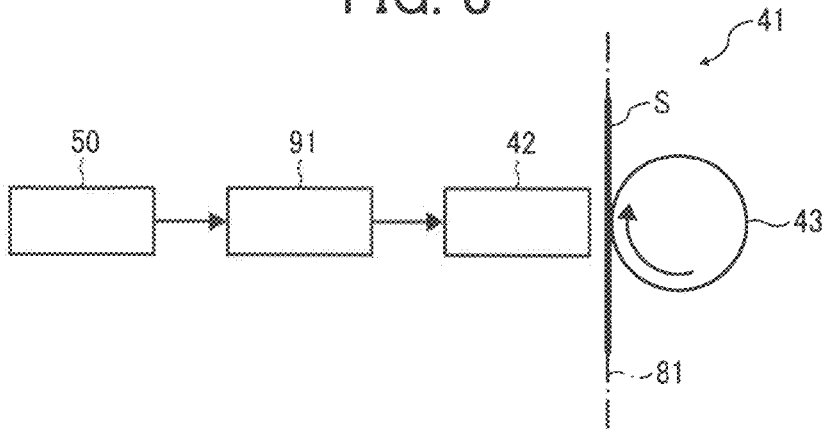

IMAGE FORMING APPARATUS WITH FIXING LIQUID APPLICATOR

CROSS-REFERENCE TO RELATED APPLICATIONS

The present patent application claims priority pursuant to 35 U.S.C. §119 from Japanese Patent Application Nos. 2010-061655 and 2010-172392, filed on Mar. 17, 2010 and Jul. 30, 2010, respectively, each of which is hereby incorporated by reference herein in its entirety.

BACKGROUND

1. Field of the Invention

The present invention relates to an image forming apparatus such as a copier, a facsimile machine, and a printer, in which a toner is fixed on a recording medium by application of heat.

2. Description of the Background

Image forming apparatuses, such as copiers, facsimiles, and printers, which form toner images on recording media are widely used. In such an image forming apparatus, toner is heated and softened to be fixed on a recording medium. To reliably fix the toner on the recording medium, the toner is required to soften sufficiently. Because the toner needs a large amount of heat to sufficiently soften, a large amount of electric power is consumed, which is against recent momentum of energy conservation. A proportion of electric power consumption in fixing toner on recording media to total electric power consumption in an image forming apparatus is relatively high. Therefore, it is desirable that electric power consumption is reduced as much as possible. There have been various attempts to reliably fix toner on recoding media.

For example, Japanese Patent No. 4224076 proposes applying a fixing liquid that softens and/or swells toner to a toner image on a recording medium. This technique meets energy conservation because no heat is required. Japanese Patent No. 4354164 also proposes a technique requiring no heat which applies a fixing liquid to a toner image on an intermediate transfer member so that the toner image is transformed into an adhesive film and makes the film-like toner image be fixed on a recording medium owing to its adhesiveness.

The above-described techniques have a problem that the toner image is disturbed upon application of the fixing liquid. To solve this problem, in Japanese Patent No. 4224076, the fixing liquid is applied to toner images on a recording medium by a non-contact ink jet method. The application amount of the fixing liquid is gradually increased along the direction of feed of the recording medium. However, it is likely that the toner powders scatter and contaminate nozzles of the ink jet head upon reception of the injected fixing liquid, even when the application amount of the fixing liquid is small. As a result, the nozzles may be clogged with the toner powders. In order to reliably fix a toner image on a recording medium, a relatively large amount of the fixing liquid is needed so that the fixing liquid reliably reaches the contact point of the toner image and the recording medium. However, such a large amount of the fixing liquid requires a large amount of heat when dried, resulting in undesired increase in energy consumption and drying time.

In Japanese Patent No. 4354164, as described above, a toner image on an intermediate transfer member is transformed into a toner film upon application of the fixing liquid at environmental temperatures. This technique has a problem that the fixing liquid is likely to contaminate image forming parts and undesirably forms toner films on the image forming parts at environmental temperatures.

Japanese Patent Application Publication No. 2007-121652 describes an image forming apparatus employing a wet developing method using a liquid developer comprising a toner and a carrier liquid. In this image forming apparatus, a fixing liquid, which is compatible with the carrier liquid, is previously applied to a recording medium and a toner layer is formed on the recording medium by the wet developing method. The carrier liquid existing between the toner particles in the toner layer is flowed so that the toner layer is dissolved and swelled to be fixed on the recording medium. This technique prevents image disturbance upon application of the fixing liquid, but causes image disturbance upon interaction between the fixing liquid and the carrier liquid. This technique also has a problem that the fixing liquid is likely to contaminate image forming parts and undesirably forms toner films on the image forming parts at environmental temperatures. It may take an unnecessarily longer time when the fixing liquid is applied before an image is transferred onto the recording medium compared to when the fixing liquid is applied after the image is transferred onto the recording medium. The fixing liquid compatible with the liquid developer may not be applicable to other images formed without the liquid developer.

Image recording methods which inject toner toward a recording medium, such as toner jet, direct toning, and toner projection, have been proposed in, for example, Japanese Patent Application Publication No. 2009-39977. In these methods, a liquid is applied to a recording medium before a toner image is formed thereon. Therefore, the occurrence of image disturbance due to application of liquid can be prevented. However, it requires a large amount of heat to dry the liquid, resulting in high electric power consumption and long fixing time. The liquid applied to the recording medium includes a softener that dissolves or swells resins included in toner. Thus, the recording medium to which the liquid is applied prevents toner from scattering and accelerates fixation of the toner. This is because the recording medium to which the liquid is applied has a higher adhesive force to toner and a lower repulsive force to toner. Specifically, the liquid is absorbed in fibers of the recording medium. Such fibers absorbing the liquid are soft enough to prevent toner from scattering. To further dissolve or swell the toner to accelerate fixation of the toner, the liquid needs to reliably contact the toner. When the injected toner reaches and adheres to the recording medium, only a slight amount of the liquid existing at the surface of the recording medium can contact the toner and most of the liquid cannot penetrate the toner layer. In this case, the toner may scatter and may not be reliably fixed on the recording medium. In a case in which the liquid is previously applied to an intermediate transfer member before a toner image is formed thereon, penetration of the liquid into the toner image may be accelerated. However, the liquid may adversely affect image forming members. In particular, surface conditions of the resulting images can be optically detected with various apparatuses disclosed in, for example, Japanese Patent Application Publication Nos. H10-49654, 2000-11493, and 2008-32675.

However, such liquids that reduce electric power consumption in fixing cause problems of, for example, image disturbance, increase in electric power consumption in drying, lengthening of fixing duration time, and contamination of image forming members, and these problems have not been solved.

SUMMARY

Exemplary aspects of the present invention are put forward in view of the above-described circumstances, and provide a novel image forming apparatus that reduces electric power consumption in fixing while preventing image disturbance, increase in electric power consumption in drying, lengthening of fixing duration time, and contamination of image forming members.

In one exemplary embodiment, a novel image forming apparatus includes a fixing liquid applicator to apply a fixing liquid to a recording medium, a transfer device to transfer a toner image from a toner image bearing member onto the recording medium to which the fixing liquid is applied while the toner image is in contact with the fixing liquid, and a fixing device to fix the toner image on the recording medium by heating the toner image and the fixing liquid. The fixing liquid comprises a plasticizer having a function to swell and soften a toner.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 6A and FIG. 6B are conceptional views illustrating toner particles transferred from a transfer belt onto a transfer paper to which a fixing liquid is applied, by noncontact and contact transfer, respectively;

FIG. 7A and FIG. 7B are conceptional views illustrating toner particles, the surfaces of which are covered with the fixing liquid, on the transfer paper before and after heat is applied thereto, respectively;

FIG. 8 schematically illustrates an embodiment of the fixing liquid applicator in the image forming apparatus illustrated in FIG. 1;

DETAILED DESCRIPTION

Figure 1:
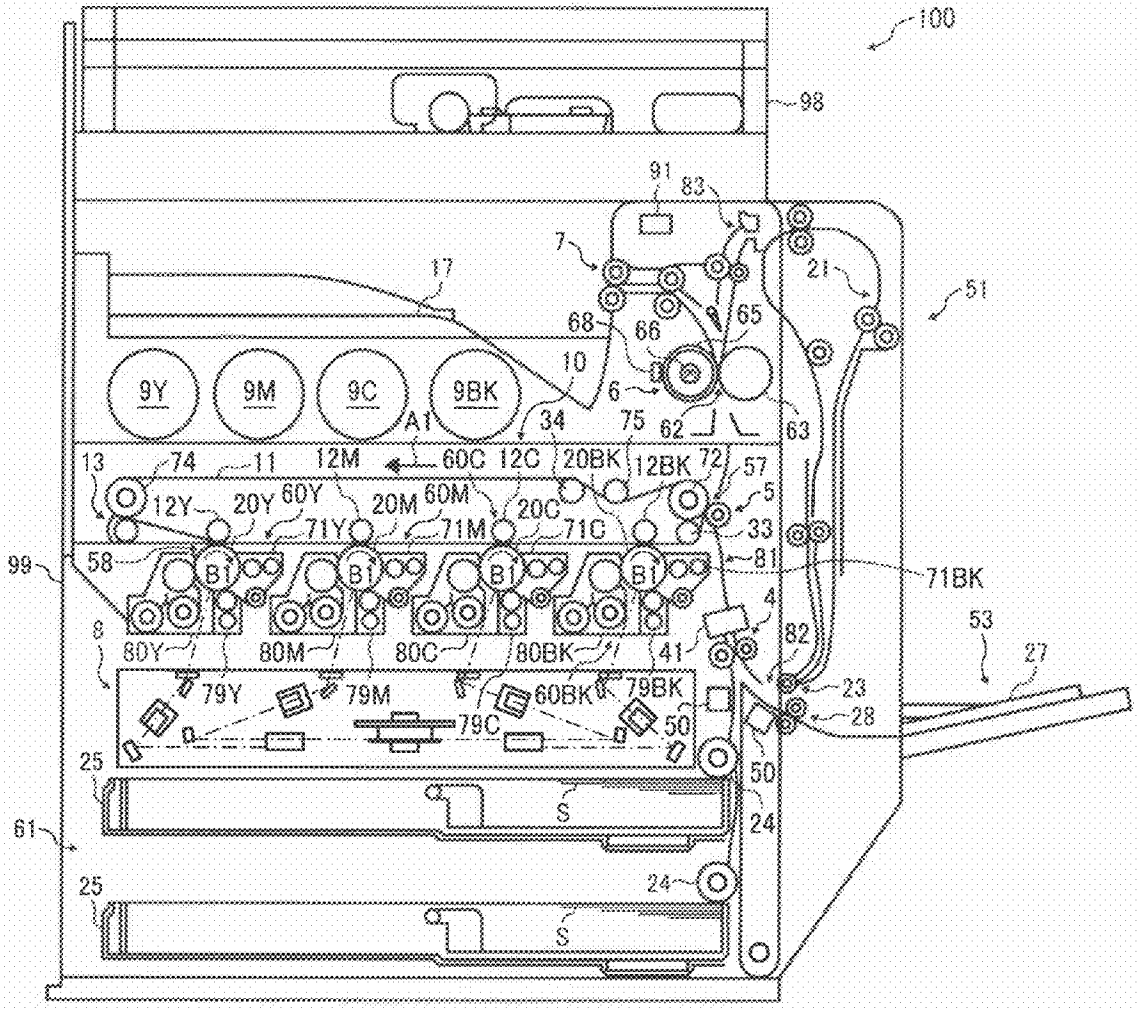
FIG. 1 schematically illustrates an image forming apparatus according to exemplary aspects of the invention.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

FIG. 1 schematically illustrates an image forming apparatus according to exemplary aspects of the invention. An image forming apparatus 100 combines functions of copier, printer, and facsimile, and produces full-color images. Exemplary aspects of the invention are not limited to the image forming apparatus 100 and may further provide a monochrome image forming apparatus, a copier, a printer, a facsimile machine, or arbitrary combinations thereof. When used as a printer, the image forming apparatus 100 operates based on image signal corresponding to image information received externally. Similarly, when used as a facsimile machine, the image forming apparatus 100 operates based on image signal corresponding to image information received externally.

The image forming apparatus 100 can form images on every kinds of sheet-like recording media, such as normal papers, OHP sheets, thick papers (e.g., cards, postcards), and envelopes. The image forming apparatus 100 can further form images on both surfaces of the sheet-like recording media.

The image forming apparatus 100 includes photoconductor drums 20Y, 20M, 20C, and 20BK that bear latent images of yellow, magenta, cyan and black, respectively. The photoconductor drums 20Y, 20M, 20C, and 20BK are tandemly arranged along a stretched surface of a transfer belt 11.

The photoconductor drums 20Y, 20M, 20C, and 20BK are rotatably supported on a flame of a main body 99 that functions as a printer part of the image forming apparatus 100. The photoconductor drums 20Y, 20M, 20C, and 20BK are arranged in this order, from the upstream side, relative to the direction of movement of the transfer belt 11, i.e., the counterclockwise direction indicated by arrow A1 in FIG. 1. The additional characters Y, M, C, and BK represent toner colors of yellow, magenta, cyan, and black, respectively.

The photoconductor drums 20Y, 20M, 20C, and 20BK are included in image forming units 60Y, 60M, 60C, and 60BK, respectively.

The photoconductor drums 20Y, 20M, 20C, and 20BK are tandemly arranged along an outer surface (i.e., an image forming surface) of the transfer belt 11 at predetermined intervals while their rotational axes being parallel. The transfer belt 11 comprised of an endless belt is provided in almost center of the main body 99.

The transfer belt 11 is movable in the direction indicated by arrow A1 while facing the photoconductor drums 20Y, 20M, 20C, and 20BK. Toner images formed on the photoconductor drums 20Y, 20M, 20C, and 20BK are transferred onto the transfer belt 11 that is moving in the direction indicated by arrow A1 and superimposed on one another. The composite toner image is further transferred onto a transfer paper S. Thus, the image forming apparatus 100 employs an intermediate transfer method. Additionally, the image forming apparatus 100 employs a tandem indirect transfer method.

A lower side of the transfer belt 11 is facing the photoconductor drums 20Y, 20M, 20C, and 20BK and forms primary transfer areas 58 therebetween.

Primary transfer rollers 12Y, 12M, 12C, and 12BK are provided facing the photoconductor drums 20Y, 20M, 20C, and 20BK, respectively, with the transfer belt 11 therebetween. The primary transfer rollers 12Y, 12M, 12C, and 12BK apply electric voltage at different timings so that each toner image formed on each of the photoconductor drums 20Y, 20M, 20C, and 20BK is transferred onto the same portion on the transfer belt 11 to form a composite toner image while the transfer belt 11 is moving in the direction indicated by arrow A1.

The image forming apparatus 100 includes the image forming units 60Y, 60M, 60C, and 60BK, a transfer belt unit 10, a secondary transfer device 5, and an optical scanning device 8, within the main body 99. The transfer belt unit 10 includes the transfer belt 11 facing the upper sides of the photoconductor drums 20Y, 20M, 20C, and 20BK. The secondary transfer device 5 is facing the rightmost side of the transfer belt 11 in FIG. 1. The optical scanning device 8 is provided facing the lower sides of the image forming units 60Y, 60M, 60C, and 60BK, and forms electrostatic latent images by emitting light to the photoconductor drums 20Y, 20M, 20C, and 20BK.

The image forming apparatus 100 also includes a sheet feeding device 61, a pair of registration rollers 4, and a sensor, within the main body 99 below the optical scanning device 8. The sheet feeding device 61 stores multiple sheets of the transfer paper S to be fed to a secondary transfer area 57 formed between the transfer belt 11 and the secondary transfer device 5. The pair of registration rollers 4 feed the transfer paper S fed from the sheet feeding device 61 toward the secondary transfer area 57 in synchronization with a formation of a toner image by the image forming units 60Y, 60M, 60C, and 60BK. The sensor detects whether a leading edge of the transfer paper S reaches the pair of registration rollers 4 nor not.

The image forming apparatus 100 further includes a fixing device 6, a fixing liquid applicator 41, a discharge roller 7, toner bottles 9Y, 9M, 9C, and 9BK, and a discharge tray 17, within the main body 99. The fixing device 6 fixes a toner image on the transfer paper S with a roller. The fixing liquid applicator 41 applies a fixing liquid to the transfer paper S before the toner is transferred onto the transfer paper S at the secondary transfer area 57. The discharge roller 7 discharges the transfer paper S having the fixed toner image from the main body 99. The toner bottles 9Y, 9M, 9C, and 9BK filled with respective toners of yellow, magenta, cyan, and black are provided above the transfer belt unit 10. The discharge tray 17 provided above the main body 99 stacks sheets of transfer paper S discharged by the discharge roller 7.

The image forming apparatus 100 further includes a duplexing unit 51 on the rightmost surface of the main body 99 and a reading device 98 above the main body 99. The reading device 98 is a scanner that reads documents.

The image forming apparatus 100 further includes paper feed paths 81 and 82 and a paper refeed path 83 within the main body 99. The paper feed path 81 is stretched almost vertically through the secondary transfer area 57, the pair of registration rollers 4, the fixing device 6, and the discharge roller 7. The transfer paper S fed from the sheet feeding device 61 is introduced in the paper feed path 81. The paper feed path 82 connects the duplexing unit 51 to the paper feed path 81 upstream from the pair of registration rollers 4 relative to the feed direction of transfer paper S. The paper refeed path 83 diverges from the paper feed path 81 toward the duplexing unit 51 downstream from the fixing device 6 relative to the feed direction of transfer paper S.

The image forming apparatus 100 further includes smoothness detectors 50 that detect smoothness of a surface of the transfer paper S to which the fixing liquid is applied by the fixing liquid applicator 41, within the main body 99. One of the smoothness detectors 50 is provided on the paper feed path 81 upstream from the junction of the paper feed paths 81 and 82, and the other is provided on the paper feed path 82.

The image forming apparatus 100 further includes a driving device that rotates the photoconductor drums 20Y, 20M, 20C, and 20BK; a CPU that controls overall operation of the image forming apparatus 100; a controller 91 including a memory; and a power source that externally supplies electricity to the image forming apparatus 100, within the main body 99.

The image forming apparatus 100 further includes a start switch and an operation panel on an outer surface of the main body 99. The operation panel is equipped with a liquid crystal display and a keyboard to enter the thickness of the transfer paper S. As shown in FIG. 1, the discharge tray 17 is provided above the main body 99 and below the reading device 98. Thus, sheets can be discharged within the space of the image forming apparatus 100.

The transfer belt unit 10 includes the transfer belt 11, the primary transfer rollers 12Y, 12M, 12C, and 12BK, a driving roller 72, a cleaning facing roller 74, stretching rollers 33 and 34, and a tension roller 75. The transfer belt 11 is stretched across the driving roller 72, the cleaning facing roller 74, and the stretching rollers 33 and 34. The tension roller 75 externally applies tension to the transfer belt 11.

The transfer belt unit 10 further includes a cleaning device 13, a belt driving device, and a bias applicator. The cleaning device 13 is provided facing the cleaning facing roller 74 and cleans the surface of the transfer belt 11. The belt driving device rotates the driving roller 72. The bias applicator applies primary transfer bias to the primary transfer rollers 12Y, 12M, 12C, and 12BK.

The cleaning facing roller 74, stretching rollers 33 and 34, and tension roller 75 are rotated in association with rotation of the transfer belt 11 driven by the driving roller 72. The primary transfer rollers 12Y, 12M, 12C, and 12BK press the transfer belt 11 against the respective photoconductor drums 20Y, 20M, 20C, and 20BK to from primary transfer nips therebetween. The primary transfer nips are formed on the transfer belt 11 stretched between the cleaning facing roller 74 and the stretching roller 33. The cleaning facing roller 74, stretching roller 33, and tension roller 75 have a function of stabilizing the primary transfer nips.

In each primary transfer nip, a primary transfer electric field is generated between each of the photoconductor drums 20Y, 20M, 20C, and 20BK and each of the primary transfer rollers 12Y, 12M, 12C, and 12BK, respectively. Toner images formed on the photoconductor drums 20Y, 20M, 20C, and 20BK are primarily transferred onto the transfer belt 11 by the effects of the primary transfer electric fields and nip pressure.

The driving roller 72 contacts the secondary transfer device 5 with the transfer belt 11 therebetween, thus forming the secondary transfer area 57. The cleaning facing roller 74 and tension roller 75 have a function of applying a predetermined tension to the transfer belt 11.

The cleaning device 13 is provided on a left lower side of the transfer belt unit 10, more specifically, below the cleaning facing roller 74. The cleaning device 13 includes cleaning members including a brush roller and a cleaning blade, a casing, and a waste toner reclaim bottle. The cleaning members are in contact with the transfer belt 11 while facing the cleaning facing roller 74. The casing stores the cleaning members. The waste toner reclaim bottle is provided on a front side of the casing relative to the plane of paper illustrating FIG. 1.

In the cleaning device 13, the cleaning members remove foreign substances such as residual toner particle from the transfer belt 11. The foreign substances removed from the transfer belt 11 are stored in the waste toner reclaim bottle. The waste toner reclaim bottle can be ejected while opening the front panel of the image forming apparatus 100, and is replaceable with a new one when filled up with foreign substances. Cleaning devices 71Y, 71M, 71C, and 71BK, to be described in detail later, also include a replaceable waste toner reclaim bottle.

The secondary transfer device 5 includes a secondary transfer roller and a spring. The secondary transfer roller is in contact with the transfer belt 11 while facing the driving roller 72. The spring presses the secondary transfer roller against the transfer belt 11 to form the secondary transfer area 57 therebetween. A voltage having a polarity opposite to that of the toner is applied from a power source to the secondary transfer roller. Thus, the secondary transfer roller transfers the toner image onto the transfer paper S owing to not only pressure to the transfer belt 11 but also the applied voltage. The secondary transfer roller also has a function of feeding the transfer paper S having the toner image thereon to the fixing device 6. The spring presses the transfer paper S against the transfer belt 11 at the secondary transfer area 57 so that the toner image is transferred from the transfer belt 11 onto one side of the transfer paper S to which the fixing liquid is applied by the fixing liquid applicator 41.

The optical scanning device 8 includes a light source such as a semiconductor laser, a polygon mirror, an F-θ lens, and a reflective mirror. The controller 91 controls the optical scanning device 8 so that the light source emits light and the polygon mirror is driven to rotate based on data corresponding to image information. Thus, the surfaces of the photoconductor drums 20Y, 20M, 20C, and 20BK are scanned with laser light beams, and as a result, respective electrostatic latent images of yellow, magenta, cyan, and black are formed thereon.

The sheet feeding device 61 stores multiple sheets of the transfer paper S, and is provided below the optical scanning device 8 within the main body 99. The sheet feeding device 61 includes multiple paper feed cassettes 25, multiple paper feed rollers 24, multiple separation rollers, and an opening and closing detector. The paper feed cassettes 25 each store multiple sheets of the transfer paper S and are vertically arranged. The paper feed roller 24 feeds the top sheet from the paper feed cassette 25. The separation roller separates the sheet fed from the paper feed roller 24. The opening and closing detector detects whether the paper feed cassette 25 is opened or closed.

When the paper feed roller 24 is driven to rotate counterclockwise in FIG. 1, the separation roller separates the top sheet in the paper feed cassette 25 and feeds it toward the pair of registration rollers 4 through the paper feed path 81. The sheet is then sandwiched with the pair of registration rollers 4.

The duplexing unit 51 includes a manual paper feeder 53 on an outer surface, a part of the paper feed path 82 crossing within the duplexing unit 51, a reversing paper feed path 21, and a feed roller 23. The reversing paper feed path 21 and the feed roller 23 reverse the transfer paper S fed from the paper refeed path 83 and feed it toward the paper feed path 82.

The manual paper feeder 53 includes a manual tray 27, a paper feed roller 28, and a separation roller. The manual tray 27 stacks the transfer paper S. The paper feed roller 28 feeds the top sheet of the transfer paper S stacked on the manual tray 27. The separation roller separates the sheet fed from the paper feed roller 28.

When the paper feed roller 28 is driven to rotate clockwise in FIG. 1, the separation roller separates the top sheet on the manual tray 27 and feeds it toward the pair of registration rollers 4. The sheet is then sandwiched with the pair of registration rollers 4.

The fixing device 6 includes a fixing roller 65, a pressing roller 63, a heater 66, and a thermistor 68. The pressing roller 63 is pressed against the fixing roller 65 to form a fixing nip 62 therebetween, through which the transfer paper S passes. The heater 66, such as a halogen heater, is provided within the fixing roller 65 and heats the fixing roller 65 to heat the fixing nip 62 to a predetermined temperature. The thermistor 68 is provided adjacent to an outer circumferential surface of the fixing roller 65 and detects the temperature of the fixing roller 65.

Figure 2:
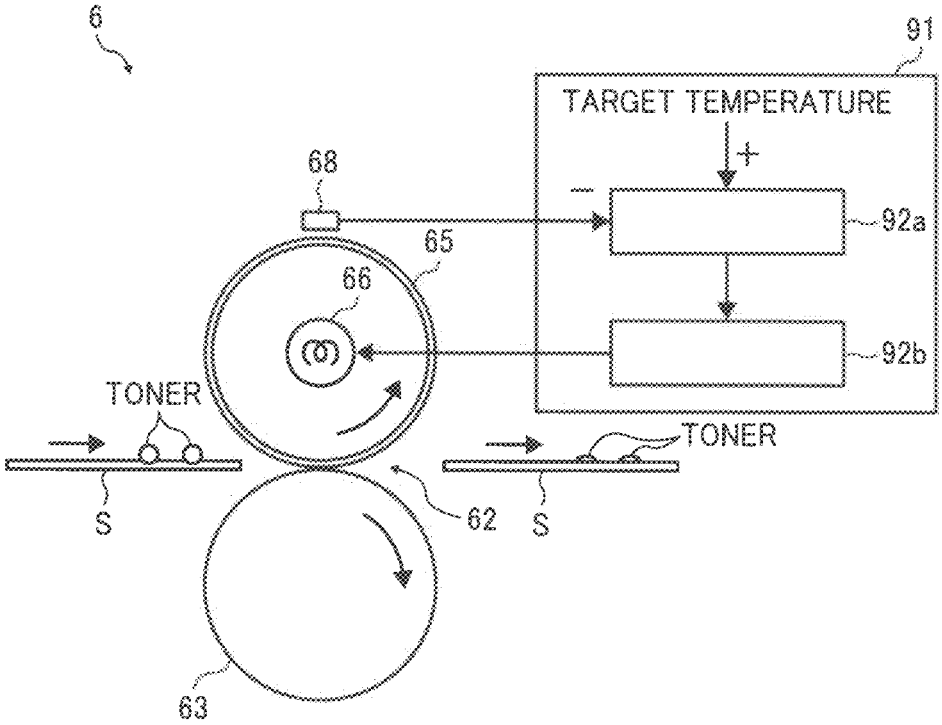
FIG. 2 is a magnified schematic view illustrating the fixing device in the image forming apparatus illustrated in FIG. 1.

FIG. 2 is a magnified schematic view illustrating the fixing device 6. As illustrated in FIG. 2, the fixing device 6 further includes a PWM driving circuit 92*a* and a fixing temperature controller 92*b*. The PWM driving circuit 92*a* drives the heater 66. The fixing temperature controller 92*b* controls the temperature of the fixing roller 65 by controlling electric power applied to the heater 66 from the PWM driving circuit 92*a* (i.e., duty per unit hour) based on information on temperature deviation between a target temperature and a detected temperature of the fixing roller 65.

The PWM driving circuit 92*a* and the fixing temperature controller 92*b* are included in the controller 91. The controller 91 controls the temperature of the fixing roller 65 to substantially control the temperature of the fixing nip 62.

In the fixing device 6, the transfer paper S having a toner image thereon passes through the fixing nip 62 while the fixing roller 65 contacting a surface of the transfer paper S having the toner image. Thus, the toner image is melted by heat and fixed on the transfer paper S by pressure.

As described above, the fixing liquid applicator 41 has applied the fixing liquid to the surface of the transfer paper S having the toner image before the transfer paper S comes into the fixing nip 62.

The toner bottles 9Y, 9M, 9C, and 9BK contain polymerized toners of yellow, magenta, cyan, and black, respectively. The toner bottles 9Y, 9M, 9C, and 9BK are driven to rotate by a driver to discharge and supply the toners to developing devices 80Y, 80M, 80C, and 80BK in the image forming units 60Y, 60M, 60C, and 60BK through pipings.

The reading device 98 includes a contact glass on which a document is put, a light source that emits light to the document on the contact glass, a first runner equipped with a first reflector that reflects the reflected light from the document, a second runner equipped with a second reflector that reflects the reflected light from the first reflector, an imaging lens that forms an image according to the reflected light from the second reflector, and a reading sensor that receives the light passed through the imaging lens to read the document.

The image forming units 60Y, 60M, 60C, and 60BK each have the same configuration. In the image forming units 60Y, 60M, 60C, and 60BK, the primary transfer rollers 12Y, 12M, 12C, and 12BK; cleaning devices 71Y, 71M, 71C, and 71BK; neutralization devices; charging devices 79Y, 79M, 79C, and 79BK each including an AC charging roller; and the developing devices 80Y, 80M, 80C, and 80BK each containing a two-component developer comprising a toner and a magnetic carrier, are respectively provided in this order around the respective photoconductor drums 20Y, 20M, 20C, and 20BK along the rotational direction indicated by arrow B1 in FIG. 1.

The developing devices 80Y, 80M, 80C, and 80BK each include a developing roller facing each of the photoconductor drums 20Y, 20M, 20C, and 20BK, an agitation screw that agitates developer, a toner concentration detector, and a toner supply device that supplies toner to the main body from each of the toner bottles 9Y, 9M, 9C, and 9BK according to the detected toner concentration. The developing roller includes a magnet fixed on a main body side and a sleeve rotatably supported outside the magnet.

The photoconductor drum 20Y, cleaning device 71Y, neutralization device, charging device 79Y, and developing device 80Y are integrated as a process cartridge. Similarly, each of the photoconductor drums 20M, 20C, and 20BK is integrated with peripherally-provided members as a process cartridge. The process cartridges are detachable in the axial direction of the photoconductor drums 20Y, 20M, 20C, and 20BK by opening the front panel of the image forming apparatus 100. It is very advantageous that such process cartridges are easily replaceable.

One of the smoothness detectors 50 is provided on the paper feed path 81 upstream from the junction of the paper feed paths 81 and 82, and the other is provided on the paper feed path 82. The smoothness detectors 50 are facing a surface of the transfer paper S onto which the toner image is transferred from the transfer belt 11 at the secondary transfer area 57.

Figure 3:
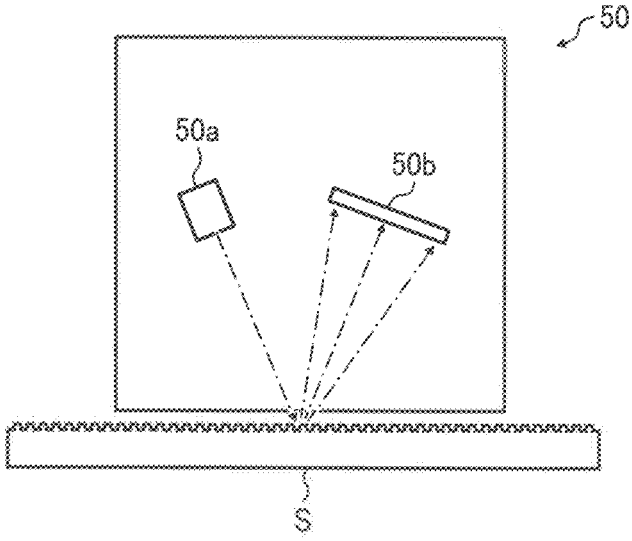
FIG. 3 schematically illustrates an embodiment of the smoothness detector in the image forming apparatus illustrated in FIG. 1.

FIG. 3 schematically illustrates an embodiment of the smoothness detector 50. The smoothness detector 50 includes a light-emitting element 50*a* that emits light to the surface of the transfer paper S and a light-receiving element 50*b* that detects the reflected light from the transfer paper S. The light-emitting element 50*a* internally includes an LED or laser diode, and a collimator lens. The light-receiving element 50*b* internally includes a line sensor or area sensor, and a lens. The light-receiving element 50*b* inputs a signal corresponding to the detected light into the controller 91.

The smoothness detector 50 optically detects smoothness of the surface of the transfer paper S based on the degree of scattering of the reflected light detected by the light-receiving element 50*b*. When the surface has high smoothness, the light-receiving element 50*b* receives a wide range of light. By contrast, when the surface has low smoothness, the light-receiving element 50*b* receives a narrow range of light. Thus, a calculation unit, comprised of a CPU and a memory in the controller 91, compares one-dimensional or two-dimensional output data of the light-receiving element 50*b* with distribution patterns stored in the memory using difference between total reflected light and scatted reflected light, to determine smoothness.

When the start switch of the image forming apparatus 100 is pushed, the image forming units 60Y, 60M, 60C, and 60BK each start image forming operation. Specifically, when a signal for image formation is input, the reading device 98 starts reading a document to obtain image information. The image information is input into the controller 91, while the driving roller 72 is driven to rotate the stretching rollers 33 and 34 and tension roller 75 and the photoconductor drums 20Y, 20M, 20C, and 20BK are driven to rotate in the direction indicated by arrow B1 in FIG. 1.

The photoconductor drums 20Y, 20M, 20C, and 20BK are uniformly charged by the respective charging devices 79Y, 79M, 79C, and 79BK, and then exposed to laser light beams emitted from the optical scanning device 8 driven by the controller 91 based on the image information, while rotating. Thus, electrostatic latent images of yellow, magenta, cyan, and black are formed on the respective photoconductor drums 20Y, 20M, 20C, and 20BK. The developing devices 80Y, 80M, 80C, and 80BK then develop the respective electrostatic latent images of yellow, magenta, cyan, and black into toner images of yellow, magenta, cyan, and black.

The toner images of yellow, magenta, cyan, and black are sequentially transferred onto the same portion of the transfer belt 11 that is rotating in the direction indicated by arrow A1 by the primary transfer rollers 12Y, 12M, 12C, and 12BK to which a voltage having a polarity opposite to that of the toner is applied, thus forming a composite full-color toner image.

Upon reception of a signal for image formation, one of the paper feed rollers 24 and 28 is driven to rotate to separate and feed a sheet of the transfer paper S from the corresponding paper feed cassette 25 or manual tray 27 toward the pair of registration rollers 4, and the sheet is stopped at the pair of registration rollers 4. In duplexing, a sheet of the transfer paper S having the fixed toner image on one side is reversed upside down and is fed toward the pair of registration rollers 4 through the reversing paper feed path 21. The sheet is stopped at the pair of registration rollers 4.

The pair of registration rollers 4 start rotating in synchronization with an entry of the composite full-color toner image into the secondary transfer area 57 along with rotation of the transfer belt 11 in the direction indicated by arrow A1. Thus, the transfer paper S is fed to the fixing liquid applicator 41 and the fixing liquid is applied to one side of the transfer paper S onto which the composite full-color toner image will be transferred.

In the secondary transfer area 57, the secondary transfer roller presses the transfer paper S to which the fixing liquid is applied against the transfer belt 11 so that the composite full-color toner image is transferred from the transfer belt 11 onto the transfer paper S due to the pressure and the voltage applied to the secondary transfer roller having a polarity opposite to that of the toner.

The transfer paper S is then fed to the fixing device 6 by the secondary transfer device 5 and the transfer belt 11 that is rotating in the direction indicated by arrow A1. In the fixing device 6, the composite full-color toner image is fixed on the transfer paper S by action of heat, pressure, and the fixing liquid, while the transfer paper S passes through the fixing nip 62 formed between the fixing roller 65 and the pressing roller 63.

The transfer paper S having the fixed composite full-color toner image thereon is discharged from the main body 99 by the discharge roller 7 and stacked on the discharge tray 17. In duplexing, the transfer paper S having the fixed toner image on one side is refeed toward the pair of registration rollers 4 through the paper refeed path 83 and the reversing paper feed path 21.

The photoconductor drums 20Y, 20M, 20C, and 20BK from which residual toner particles have been removed by the respective cleaning devices 71Y, 71M, 71C, and 71BK and neutralized by the neutralization devices are then charged again by the respective charging devices 79Y, 79M, 79C, and 79BK to be ready for a next operation.

The transfer belt 11 passed through the secondary transfer area 57 is then cleaned by the cleaning device 13 to be ready for a next operation.

Exemplary embodiments of the fixing liquid are described in detail below. The fixing liquid comprises a plasticizer that swells and softens the toner to make the toner easily fixed on the transfer paper S; a surfactant that improves permeability of the fixing liquid to the toner; and a solvent that dilutes the plasticizer and the surfactant.

The plasticizer may be a solid plasticizer that softens when heated. More specifically, the solid plasticizer softens when heated in the fixing device 6 to a temperature about 40 to 50° C. higher than environmental temperature. The environmental temperature may be a normal room temperature or an atmosphere temperature in the main body 99 not near the fixing device 6 in heating operation.

Thus, the plasticizer never functions even when adhered to any member in the image forming apparatus 100 other than the fixing device 6, such as the transfer belt 11 or the secondary transfer roller, suppressing contamination of such members.

When heated in the fixing device 6 above the environmental temperature, the plasticizer swells and softens the toner to make the toner easily fixed on the transfer paper S. This phenomenon is described in detail below with reference to FIG. 4.

Figure 4:
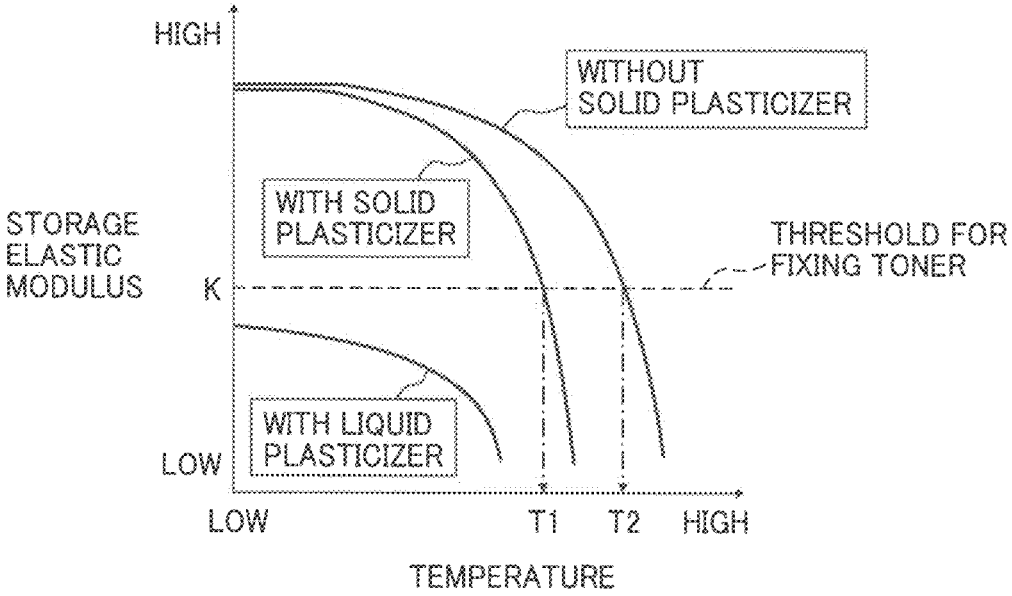
FIG. 4 is a conceptual diagram showing that the minimum fixable temperature of toner is decreased in the presence of a plasticizer.

FIG. 4 is a conceptual diagram showing that the minimum fixable temperature of toner is decreased in the presence of a plasticizer. In FIG. 4, the storage elastic modulus represents hardness of toner. The higher the storage elastic modulus, the harder the toner. The lower the storage elastic modulus, the softer the toner. When the storage elastic modulus is K or less, the toner can be fixed on the transfer paper S. Therefore, the temperature at which the storage elastic modulus is K represents the minimum fixable temperature of the toner. In FIG. 4, the "solid plasticizer" represents the above-described plasticizer included in the fixing liquid used in the image forming apparatus 100. Before added to the fixing liquid, this plasticizer is solid at the environmental temperature. In FIG. 4, the "liquid plasticizer" represents a plasticizer being liquid at the environmental temperature.

The minimum fixable temperature T1, in a case in which the fixing liquid including the solid plasticizer is applied to the toner, is lower than the minimum fixable temperature T2, in a case in which no fixing liquid is applied to the toner. Therefore, the target temperature of the fixing roller 65 can be set lower when the fixing liquid including the solid plasticizer is applied to the toner, resulting in electric power consumption reduction in the fixing device 6 and the image forming apparatus 100.

FIG. 4 shows that the liquid plasticizer is capable of softening the toner at a temperature below T1, i.e., the environmental temperature. By contrast, FIG. 4 also shows that the solid plasticizer is not capable of softening the toner at the environmental temperature. Therefore, the fixing liquid including the liquid plasticizer possibly contaminates the image forming apparatus 100 while the fixing liquid including the solid plasticizer does not. Whether a plasticizer, that decreases storage elastic modulus of toner, contaminates the image forming apparatus 100 or not depends on whether the plasticizer is solid or liquid. Thus, the image forming apparatus 100 employs a fixing liquid including a plasticizer being solid at the environmental temperature.

The solid plasticizer is a compound having an ethylene oxide group —$(CH_2CH_2O)$— and/or a propylene oxide group —$(CH(CH_3)CH_2O)$—, such as a glycol ether or a glycol fatty acid ester, being solid at room temperature. The melting point is preferably 40° C. or more, and more preferably 50° C. or more.

Preferably, the plasticizer is a polyoxyethylene glycol having the following formula (1):

$$HO—(CH_2CH_2O)n—OH \quad (1)$$

wherein n represents a numeral of 10 or more, and is preferably 100 or less. When n is too small, the compound (1) may not be solid at room temperature. When n is too large, molecules may become too large to express plasticizing ability when heated, resulting in insufficient softening of the toner. Specific examples of commercially available materials having the formula (1) include, but are not limited to, polyethylene glycol #1000, polyethylene glycol #1540, polyethylene glycol #2000, polyethylene glycol #4000, polyethylene glycol #6000, and polyethylene glycol #8000.

Alternatively, the plasticizer may be a polyoxyethylene polyoxypropylene glycol having the following formula (2):

$$HO—(CH_2CH_2O)n(CH(CH_3)CH_2O)m—OH \quad (2)$$

wherein n represents a numeral of 10 or more, preferably 200 or less; and m represents a numeral of 5 or more, preferably 50 or less. When n is too small, the compound (2) may not be solid at room temperature. When n is too large, molecules may become too large to express plasticizing ability when heated, resulting in insufficient softening of the toner. When m is too small, the compound (2) may not be solid at room temperature. When m is too large, molecules may become too large to express plasticizing ability when heated, resulting in insufficient softening of the toner. Specific examples of commercially available materials having the formula (2) include, but are not limited to, EMULGEN 290 from Kao Corporation and EPAN 450, EPAN 750, and EPAN 785 from Dai-ichi Kogyo Seiyaku Co., Ltd.

Alternatively, the plasticizer may be a polyoxyethylene alkyl ether having the following formula (3):

$$R—O—(CH_2CH_2O)n—OH \quad (3)$$

wherein n represents a numeral of 10 or more, and is preferably 100 or less. When n is too small, the compound (3) may not be solid at room temperature. When n is too large, molecules may become too large to express plasticizing ability when heated, resulting in insufficient softening of the toner. R represents a straight or branched alkyl group preferably having 10 to 22 carbon atoms. When the number of carbon atom is too small, the compound (3) may be too soft and may irritate skins or eyes. When the number of carbon atom is too large, plasticizing ability is too weak when heated, resulting in insufficient softening of the toner. Specific examples of commercially available materials having the formula (3) include, but are not limited to, EMULGEN 350, EMULGEN 420, and EMULGEN 4085 from Kao Corporation and EMALEX 611, EMALEX 620, EMALEX 710, and EMALEX 720 from Nihon Emulsion Co., Ltd.

Alternatively, the plasticizer may be a polyoxyethylene fatty acid ester or polyoxyethylene fatty acid diester having the following formula (4) or (5):

$$R—COO—(CH_2CH_2O)n—OH \quad (4)$$

$$R—COO—(CH_2CH_2O)n—COO—R' \quad (5)$$

wherein n represents a numeral of 10 or more, and is preferably 100 or less. When n is too small, the compound (4) or (5) may not be solid at room temperature. When n is too large, molecules may become too large to express plasticizing ability when heated, resulting in insufficient softening of the toner. R and R' each represent a normal or branched alkyl group preferably having 10 to 22 carbon atoms. When the number of carbon atom is too small, the compound (4) or (5) may be too soft and may irritate skins or eyes. When the number of carbon atom is too large, plasticizing ability is too weak when heated, resulting in insufficient softening of the toner. Specific examples of commercially available materials having the formula (4) or (5) include, but are not limited to, EMANON 3199V and EMANON 3299RV from Kao Corporation and EMALEX 820 and EMALEX 830 from Nihon Emulsion Co., Ltd.

The surfactant improves permeability of the fixing liquid to the toner. Preferably, the surfactant is a nonionic surfactant. Specific examples of the nonionic surfactants include, but are not limited to, polyoxyethylene alkyl ethers and acetylene-based surfactants. Specific examples of the polyoxyethylene alkyl ethers include, but are not limited to, polyoxyethylene lauryl ether and polyoxyethylene alkyl(12-14) ether (12E.O.) such as BT-12 available from Nikko Chemicals Co., Ltd. Specific examples of the acetylene-based surfactants include, but are not limited to, acetylene glycol such as OLFINE 1010 and OLFINE 4051F available from Nissin Chemical Co., Ltd.

Preferably, the solvent for diluting the plasticizer and surfactant is water. For example, urban water from which impurities (e.g., metal ions such as calcium ion and magnesium ion) have been removed and ion-exchange water are preferable. The water is not necessarily distilled.

The target temperature of the fixing roller 65, for fixing toner images on the transfer paper S to which the fixing liquid including the solid plasticizer is applied, is determined as follows. The target minimum fixable temperature is decreased owing to the presence of the fixing liquid, to the extent that certain smear property is maintained. The smear property is determined by rubbing the fixed toner image on the transfer paper S with a specific material. The degree of toner contamination of the material indicates fixing strength of the toner on the transfer paper S. The degree of toner contamination is determined by measuring the image density (hereinafter "smear ID") of the toner adhered to the material. The higher the smear ID, the poorer the fixing strength. When the smear ID is 0.40 or less, there is no problem in practical use. Accordingly, the target temperature of the fixing roller 65 is set to a temperature at which the storage elastic modulus is K or less and the smear ID is 0.40 or less.

Figure 5:
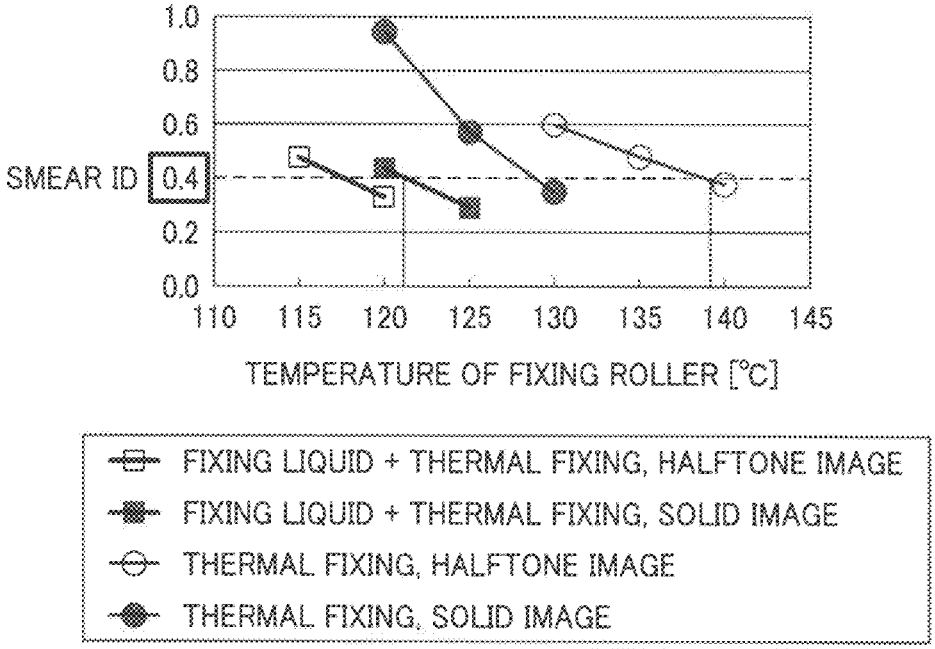
FIG. 5 is a graph showing relations between the temperature of a fixing roller and smear ID.

FIG. 5 is a graph showing relations between the temperature of the fixing roller and smear ID. FIG. 5 compares the image forming apparatus 100 that applies the fixing liquid to the transfer paper S and a conventional image forming apparatus using no fixing liquid, and shows that the smear property is much better in the image forming apparatus 100 using the fixing liquid. The fixing liquid used for the experiment includes 25% by weight of polyethylene glycol #2000 as a solid plasticizer, 0.5% by weight of OLFIN 4051F as a surfactant, and ion-exchange water as a solvent.

The smear property is determined by a smear tester, which is a friction tester type I according to JIS L0823 having a friction member having a diameter of 15ϕ. A white cotton cloth (JIS L0803 cotton No. 3) of 25×25 mm is adhered to the friction member with a double-faced adhesive tape so that the fiber direction of the cloth is coincident with the direction of movement of the friction member. The friction member frictionizes toner images back and forth for 5 times continuously. One of the toner images is a halftone image having an image area occupation of 55% and the other is a solid image having an image area occupation of 100%. The cloth is removed from the friction member and subjected to measurement of image density using a spectrophotometer (938 spectrodensitometer from X-Rite). Randomly selected 3 portions on the cloth where the toner is adhered are subjected to the measurement, and the measured image density values are averaged to determine the smear ID. The lower the smear ID, the less contamination of the cloth. When the smear ID is 0.40 or less, there is no problem in practical use.

It is clear from FIG. 5 that the target temperature of the fixing roller 65 can be set to a relatively low temperature of 121° C. in the image forming apparatus 100 while that should be set to 139° C. in the conventional image forming apparatus, in order to keep desired smear property.

In view of the experimental results shown in FIG. 5, the target fixing temperature is set to 121° C. in the image forming apparatus 100. On the other hand, the target fixing temperature should be set to 139° C. in the conventional image forming apparatus, which is 18° C. higher than in the image forming apparatus 100. Accordingly, the image forming apparatus 100 contributes to energy saving and environmental load reduction. Usable fixing liquid is not limited to that including 25% by weight of polyethylene glycol #2000 as a solid plasticizer, 0.5% by weight of OLFIN 4051F as a surfactant, and ion-exchange water as a solvent. The target fixing temperature is not limited to the above-described temperature. For example, the target fixing temperature is variable by varying the plasticizer concentration.

A reason why the image forming apparatus 100 is capable of fixing toner images at very low temperatures without degrading smear property is not only that the fixing liquid including the solid plasticizer is used but also that the fixing liquid is previously applied to the transfer paper S before a toner image is transferred onto the transfer paper S from the transfer belt 11 by the secondary transfer device 5 and then fixed by the fixing device 6.

FIG. 6A and FIG. 6B are conceptional views illustrating toner particles transferred from the transfer belt 11 onto the transfer paper S to which the fixing liquid is applied, by noncontact and contact transfer, respectively. In contact transfer shown in FIG. 6B, the fixing liquid penetrates between toner particles by capillary action and reaches toner particles contacting the transfer belt 11, i.e., existing at the surface of the toner layer. Toner particles existing near the transfer paper S receive a greater amount of the fixing liquid. Capillary action is more accelerated in contact transfer shown in FIG. 6B in which toner particles on the transfer belt 11 are contacted against the transfer paper S compared to in noncontact transfer shown in FIG. 6A in which toner particles on the transfer belt 11 are allowed to electrostatically fly toward the transfer paper S. Thus, the fixing liquid more penetrates between toner particles in contact transfer shown in FIG. 6B in which toner particles on the transfer belt 11 are pressed against the transfer paper S compared to noncontact transfer shown in FIG. 6A.

FIG. 7A and FIG. 7B are conceptional views illustrating toner particles, the surfaces of which are covered with the fixing liquid, on the transfer paper S before and after heat is applied thereto, respectively. As shown in FIG. 7B, upon application of heat in the fixing nip 62, the heated plasticizer in the fixing liquid swells and softens the toner particles. In the fixing nip 62, penetration of the fixing liquid into the toner layer is accelerated due to pressure. Additionally, fixation of the softened toner particles on the transfer paper S is accelerated by anchor effect. Because heat is applied from the surface of the toner layer, toner particles existing near the transfer paper S receives less heat than those existing near the surface. However, because the toner particles existing near the transfer paper S is satisfactorily covered with the fixing liquid, they can be efficiently fixed on the transfer paper S owing to function of the heated plasticizer. The transfer paper S absorbs less heat and more efficiently heats the plasticizer in the present embodiment in which heat is applied form the toner layer side compared to an embodiment in which heat is applied from the back side of the transfer paper S. To make it possible to heat the transfer paper S from the back side, the pressing roller 63 may include a heater. In this case, the transfer paper S may also be heated from the toner layer side to the extent that energy conservation is achieved.

In the image forming apparatus 100, the fixing liquid is applied to the transfer paper S. The fixing liquid functions at relatively low temperatures. When a toner image is transferred onto the transfer paper S by contact transfer, the fixing liquid is efficiently adhered to toner particles existing near the transfer paper S. Thus, the toner particles existing near the transfer paper S can be satisfactorily softened at lower temperatures with less heat. Previously applying the fixing liquid to the transfer paper S so that the fixing liquid efficiently adheres to the toner particles existing near the transfer paper S in the contact transfer is more advantageous than supplying the fixing liquid from the surface side of the toner layer, because the former case consumes a smaller amount of the fixing liquid. Additionally, the former case more contributes to reduction of electric power consumption and required time in drying the fixing liquid. The contact transfer that uses capillary action is more advantageous than the noncontact transfer in which toner particles are allowed to fly toward the transfer paper S in terms of consumption of the fixing liquid. The contact transfer consumes a smaller amount of the fixing liquid and more contributes to reduction of electric power consumption and required time in drying the fixing liquid, than the noncontact transfer.

Because the fixing liquid is applied to the transfer paper S before a toner image is transferred thereon, the toner image is never disturbed by application of the fixing liquid. The fixing liquid never adversely affects the transfer belt 11 even when adhered thereto, because it functions only when heat is applied. The above-described embodiments are applicable not only to liquid developing techniques but also to other developing techniques.

The fixing liquid prevents deterioration of transferability because there is no bubble. If the fixing liquid is a foam-like material, it may deteriorate transferability. The fixing liquid does not contaminate or degrade the members such as the photoconductor drums 20Y, 20M, 20C, and 20BK and transfer belt 11, because the fixing liquid is never applied to toner images in the image forming apparatus 100.

FIG. 8 schematically illustrates an embodiment of the fixing liquid applicator 41.

The fixing liquid applicator 41 includes a head 42, a facing roller 43, and a head driver. The head 42 is a piezo-type inkjet head that discharges the fixing liquid toward the transfer paper S passing through the paper feed path 81. The facing roller 43 is provided on the opposite side of the head 42 relative to the paper feed path 81.

The head 42 is provided facing the side of the transfer paper S onto which a toner image is transferred, and discharges the fixing liquid toward the side of the transfer paper S. The head 42 includes multiple nozzles that discharge the fixing liquid. The nozzles are arranged in a direction orthogonal to the direction of feed of the transfer paper S and a direction vertical to the plane of paper illustrating FIG. 8, thus forming nozzle arrays. The nozzle arrays are arranged in a hound-stooth check pattern in the direction of feed of the transfer paper S. The number of the nozzle arrays depends on the liquid droplet diameter discharged from the nozzles. The smaller the liquid droplet diameter, the greater the number of the nozzle arrays.

The head 42 is driven by the controller 91 via the head driver. The controller 91 controls both the fixing liquid applicator 41 that applies the fixing liquid to the transfer paper S and the head 42 that discharges the fixing liquid toward the transfer paper S.

The controller 91 drives the head 42 so that the fixing liquid is applied to an area on the transfer paper S onto which a toner image is to be transferred based on image information input in the controller 91, while the transfer paper S passes through between the head 42 and the facing roller 43 on the way from the pair of registration rollers 4 to the secondary transfer area 57. Thus, the controller 91 determines whether or not the fixing liquid is applied to each area on the transfer paper S based on the image information, and transmits a signal to the head driver for driving the head 42. The head driver turns on/off the head 42 based on the signal.

Accordingly, fixing liquid consumption can be more reduced, fixing liquid contamination of the main body 99 can be more prevented, and the transfer paper S can be more reliably conveyed in the present embodiment compared to a case in which the fixing liquid is applied to the whole surface of the transfer paper S. The head 42 applies the fixing liquid to at least areas on the transfer paper S onto which a toner image is to be transferred. The head 42 may apply the fixing liquid beyond such areas. In each case, it is more advantageous than a case in which the fixing liquid is applied to the whole surface of the transfer paper S.

Because the fixing liquid is applied to the transfer paper S before a toner image is transferred thereon, toner scattering upon application of the fixing liquid and nozzle clogging with the scattered toner are prevented.

When an A4-size normal paper (RICOPY PPC PAPER TYPE 6200 from Ricoh Co., Ltd.) is used as the transfer paper S in the image forming apparatus 100, 170 mg of the fixing liquid is uniformly applied to a sheet of the transfer paper S upon formation of a solid image. The application amount of the fixing liquid is determined based on the surface smoothness of the transfer paper S detected by the smoothness detectors 50, so that the fixing liquid satisfactorily penetrates the transfer paper S by anchor effect.

Figure 9:
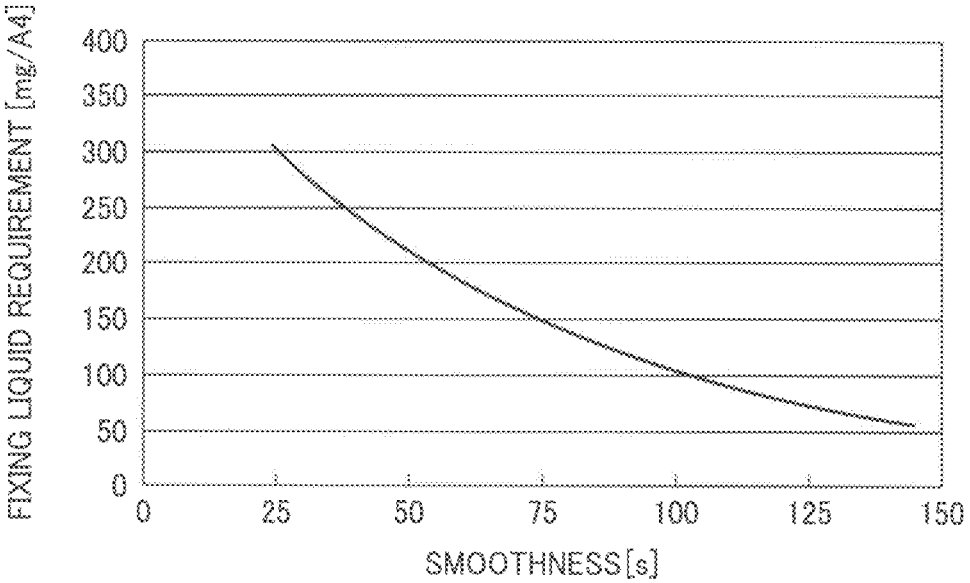
FIG. 9 is a graph showing a relation between smoothness of the transfer paper and fixing liquid requirement for ensuring anchor effect.

FIG. 9 is a graph showing a relation between smoothness of the transfer paper S and fixing liquid requirement for ensuring anchor effect. FIG. 9 shows a case in which the above-described A4-size paper is employed as the transfer paper S. Because each nozzle discharges a constant amount of the fixing liquid, the fixing liquid requirement depends on the area on the transfer paper S onto which a toner image is to be transferred.

The controller 91 is storing data regarding a relation between smoothness of the transfer paper S and fixing liquid requirement, as shown in FIG. 9, for every types of the transfer paper S in a memory. Thus, the controller 91 determines the fixing liquid requirement (i.e., the amount of the fixing liquid to be discharged from the head 42 or each nozzle) based on the surface smoothness of the transfer paper S detected by the smoothness detectors 50. The controller 91 functions as both a fixing liquid requirement memory and a fixing liquid requirement determiner. The fixing liquid requirement is determined so that the fixing liquid can be completely dried by heating in the fixing nip 62 and needs not to be dried by a drying mechanism.

The controller 91 controls the application amount of the fixing liquid to the transfer paper S by controlling voltage applied to the head driver. Accordingly, the controller 91 also functions as a fixing liquid application controller as well as the fixing liquid requirement memory and fixing liquid requirement determiner.

The head 42 may employ either a piezo-type head or a thermal-type inkjet head. When using the thermal-type inkjet head, the temperature of the head should be carefully controlled so that the fixing liquid may not expresses softening effect.

Figure 10:
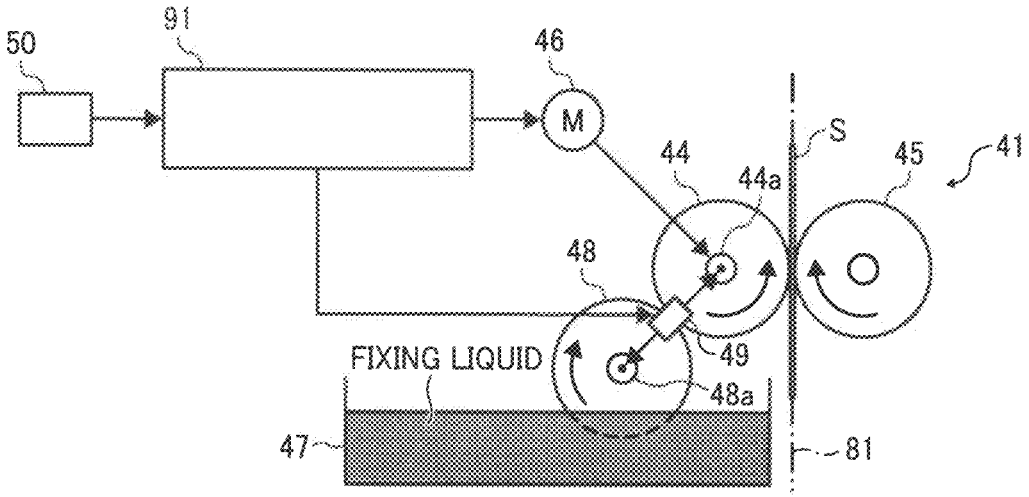
FIG. 10 schematically illustrates another embodiment of the fixing liquid applicator.

FIG. 10 schematically illustrates another embodiment of the fixing liquid applicator 41. The fixing liquid applicator 41 includes an application roller 44, a facing roller 45, a motor 46, a liquid chamber 47, and a supply roller 48. The application roller 44 applies the fixing liquid to the transfer paper S passing through the paper feed path 81. The facing roller 45 is provided on the opposite side of the application roller 44 relative to the paper feed path 81. The motor 46 drives the application roller 44 to rotate. The liquid chamber 47 stores the fixing liquid. The supply roller 48 is immersed in the fixing liquid and rotated along with rotation of the application roller 44 so as to bear the fixing liquid on its surface and supply it to the application roller 44.

The fixing liquid applicator 41 further includes an actuator 49 and drivers for driving the motor 46 and the actuator 49. The actuator 49 varies the amount of the fixing liquid supplied from the supply roller 48 to the application roller 44 by varying the pressure between the application roller 44 and the supply roller 48 so that the amount of the fixing liquid applied from the application roller 44 to the transfer paper S is varied.

The application roller 44 is provided facing the side of the transfer paper S onto which a toner image is transferred, and applies the fixing liquid to the side of the transfer paper S. The facing roller 45 is rotated along with rotation of the application roller 44, or conveyance of the transfer paper S by rotation of the application roller 44. The facing roller 45 is a glass beads roller comprised of a stainless steel core shaft having a diameter of 25 mm, chloroprene wound around stainless steel core shaft, and glass beads having a diameter of 100 μm fixed on the surface with an epoxy adhesive.

Each of the application roller 44 and supply roller 48 is a roller comprised of a stainless steel core shaft having a diameter of 25 mm and chloroprene wound around the stainless steel. The roller has a JIS-A hardness of 35 degrees. The application roller 44 and supply roller 48 include respective axes 44*a* and 48*a* being rotation centers.

The longitudinal directions of the axes 44*a* and 48*b* are coincident with the direction vertical to the plane of paper illustrating FIG. 10.

The rotation centers of the application roller 44 and facing roller 45 are located on the same level. The rotation center of the supply roller 48 is located on a level 10 mm lower than that of the application roller 44. The supply roller 48 is immersed in the fixing liquid in the liquid chamber 47 for a depth of 5 mm. Because the rotation centers of the application roller 44 and supply roller 48 are located on different levels, the supply roller 48 may not influence the pressure between the application roller 44 and the facing roller 45 upon entry of the transfer paper S into between the application roller 44 and facing roller 45.

The application roller 44 is driven to rotate by the motor 46 driven by the controller 91 via the driver. The controller 91 functions as a fixing liquid applicator controller that controls application of the fixing liquid from the fixing liquid applicator 41 to the transfer paper S as well as a fixing liquid applicator driver controller that controls application of the fixing liquid from the application roller 44 to the transfer paper S.

The controller 91, as the fixing liquid applicator driver controller, drives the application roller 44 to rotate by driving the motor 46 so that the fixing liquid is applied to the transfer paper S while the transfer paper S fed from pair of registration rollers 4 toward the secondary transfer area 57 is passing through between the application roller 44 and facing roller 45. Thus, the controller 91, as the fixing liquid applicator driver controller, transmits a signal for driving the motor 46 to the driver according to driving information of the pair of registration rollers 4. The driver turns on/off the motor 46 based on the signal so that the application roller 44 appropriately applies the fixing liquid to the transfer paper S.

The actuator 49 varies the pressure between the application roller 44 and supply roller 48 by bringing both ends of the axes 44*a* and 48*a* closer to each other or drawing them away from each other. The actuator 49 includes springs on both ends of the axes 44*a* and 48*a* and an actuator that varies the pressing forces of the springs. Driving of the actuator is controlled by the controller 91.

When an A4-size normal paper (RICOPY PPC PAPER TYPE 6200 from Ricoh Co., Ltd.) is used as the transfer paper S in the image forming apparatus 100, the controller 91 controls the actuator 49 so that 170 mg of the fixing liquid is uniformly applied to a sheet of the transfer paper S upon formation of a solid image. The application amount of the fixing liquid is determined based on the surface smoothness of the transfer paper S detected by the smoothness detectors 50, so that the fixing liquid satisfactorily penetrates the transfer paper S by anchor effect.

Figure 11:
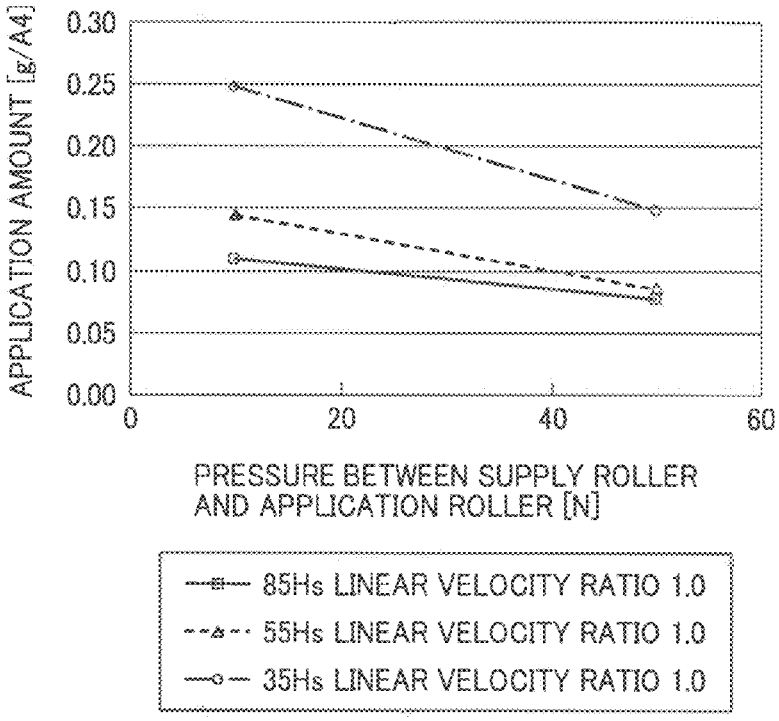
FIG. 11 is a graph showing relations of pressure between the application roller and supply roller in the fixing liquid applicator with application amount of the fixing liquid to the transfer paper.

The controller 91 determines the fixing liquid requirement based on the data stored in the memory of the controller 91 according to the surface smoothness of the transfer paper S detected by the smoothness detectors 50. FIG. 11 is a graph showing relations of pressure between the application roller 44 and supply roller 48 with application amount of the fixing liquid to the transfer paper S. The controller 91 stores data regarding such relations in the memory. Thus, the controller 91 sets the pressure between the application roller 44 and supply roller 48 based on the data stored in the memory, and drives the actuator accordingly. In view of this, the controller 91 also functions as a fixing liquid application amount controller.

Accordingly, fixing liquid scattering can be reduced, fixing liquid contamination of the main body 99 can be prevented, and the transfer paper S can be more reliably conveyed. The actuator 49 is not necessarily needed, as shown in the simpler embodiment illustrated in FIG. 8.

Because the fixing liquid is applied to the transfer paper S before a toner image is transferred thereon, disturbance of toner image upon application of the fixing liquid by the application roller 44, adherence of the toner image to the application roller 44, and toner contamination of the produced image are prevented.

When an A4-size normal paper (RICOPY PPC PAPER TYPE 6200 from Ricoh Co., Ltd.) is used as the transfer paper S in the image forming apparatus 100, for example, 170 mg of the fixing liquid is uniformly applied to a sheet of the transfer paper S. The application amount is determined so that the fixing liquid can be completely dried by heating in the fixing nip 62.

The paper feed path 81 can be formed by guide members. In this case, the guide members are provided only on the back side of the transfer paper S on downstream sides from the fixing liquid applicator 41 and upstream sides from the fixing device 6 relative to the direction of feed of the transfer paper S. Because the opposite side of the transfer paper S, i.e., the surface having a toner image does not contact any guide member, the fixing liquid and the toner image are never disturbed.

The controller 91 stores in the memory a fixing program and image forming program for executing a fixing method and image forming method that use the fixing liquid applicator 41 that applies the fixing liquid including a plasticizer that swells and softens toner to the transfer paper S before a toner image is transferred thereon; the secondary transfer device 5 that transfers the toner image by contact transfer from the transfer belt 11 onto the transfer paper S to which the fixing liquid is applied; and the fixing device 6 that fixes the toner image on the transfer paper S by application of heat. In view of this, the controller 91 functions as a fixing program memory and an image forming program memory. The fixing program and image forming program can also be stored in other memories such as semiconductor media (e.g., ROM, nonvolatile memory), optical media (e.g., DVD, MO, MD, CD-R), and magnetic media (e.g., hard disk, magnetic tape, flexible disk). Such memories storing the fixing program and image forming program are computer-readable.

Having generally described this invention, additional modifications and variations of the present invention are possible in light of the above teachings. It is therefore to be understood that within the scope of the appended claims the invention may be practiced other than as specifically described herein.

For example, another property other than the smoothness of the transfer S can be detected for the purpose of controlling the application amount of the fixing liquid unless that that property influences anchor effect. On the other hand, the smoothness is most preferable because the smoothness has the most powerful influence on anchor effect.

Figure 12:
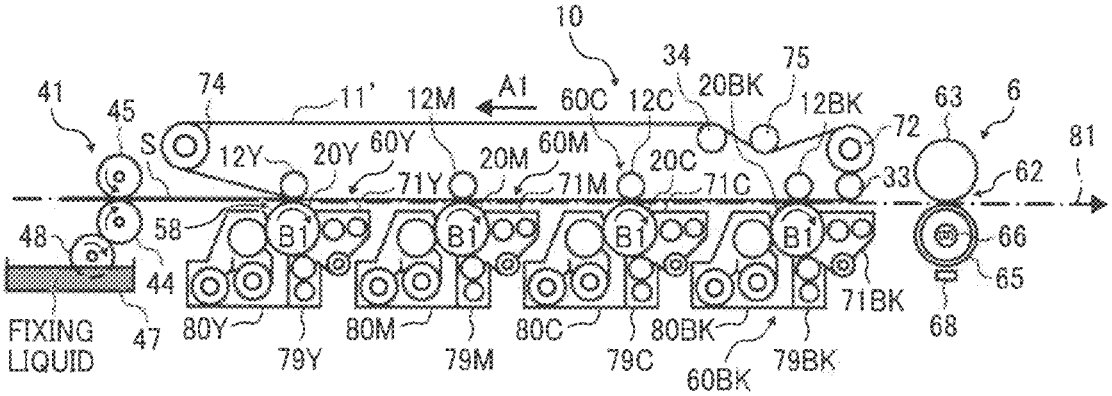
FIG. 12 schematically illustrates another tandem-type image forming apparatus according to exemplary aspects of the invention, employing a direct transfer method.

FIG. 12 schematically illustrates another tandem-type image forming apparatus according to exemplary aspects of the invention, employing a direct transfer method. An image forming apparatus illustrated in FIG. 12 has a similar configuration to the tandem-type image forming apparatus 100 employing an intermediate transfer method illustrated in FIG. 1. For the sake of simplicity, the same reference number will be given to identical constituent elements such as parts and materials having the same functions and redundant descriptions thereof omitted unless otherwise stated.

In this tandem-type image forming apparatus employing a direct transfer method, the transfer belt 11 is replaced with a sheet conveyance belt 11'. Toner images formed on the photoconductor drums 20Y, 20M, 20C, and 20BK in the respective image forming units 60Y, 60M, 60C, and 60BK are sequentially transferred by the respective primary transfer rollers 12Y, 12M, 12C, and 12BK onto the transfer paper S to which the fixing liquid is applied from the fixing liquid applicator 41, while the transfer paper S is conveyed by the sheet conveyance belt 11'.

The fixing liquid applicator 41 illustrated in FIG. 12 has a similar configuration to that illustrated in FIG. 10. The application roller 44 and facing roller 45 are facing each other in a vertical direction. The rotation center of the supply roller 48 is located on a level 10 mm lower than that of the application roller 44. The supply roller 48 is immersed in the fixing liquid in the liquid chamber 47 for a depth of 5 mm. Because the rotation centers of the application roller 44 and supply roller 48 are located on different levels, the supply roller 48 may not influence the pressure between the application roller 44 and the facing roller 45 upon entry of the transfer paper S into between the application roller 44 and facing roller 45. The image forming apparatus illustrated in FIG. 12 may include the fixing liquid applicator 41 illustrated in FIG. 8.

A tandem-type image forming apparatus employing an intermediate transfer method may have a configuration in which toner images are directly formed on the transfer belt 11 without using the photoconductor drums 20Y, 20M, 20C, and 20BK.

Figure 13:
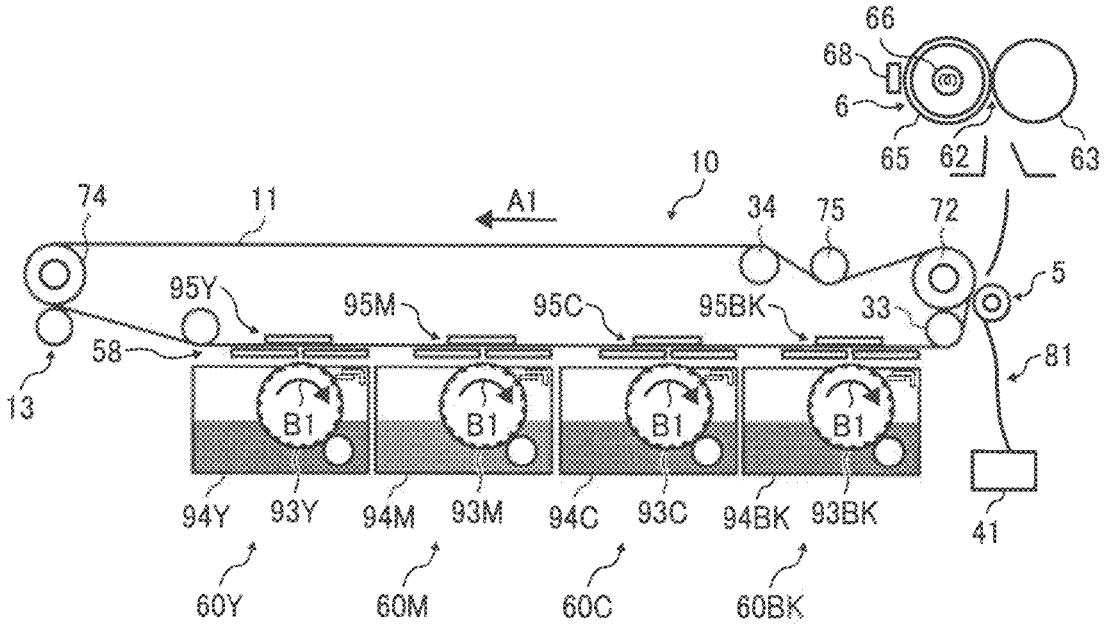
FIG. 13 schematically illustrates another tandem-type image forming apparatus according to exemplary aspects of the invention, employing an intermediate transfer method.

FIG. 13 schematically illustrates such a tandem-type image forming apparatus according to exemplary aspects of the invention, employing an intermediate transfer method. For the sake of simplicity, the same reference number will be given to identical constituent elements such as parts and materials having the same functions and redundant descriptions thereof omitted unless otherwise stated.

An image forming apparatus illustrated in FIG. 13 is what is called a toner jet, direct toning, or toner production, in which a toner flies toward the transfer belt 11 to directly form a toner image thereon. The image forming apparatus includes image forming units 60Y, 60M, 60C, and 60BK including respective toner bearing members 93Y, 93M, 93C, and 93BK; toner injectors 94Y, 94M, 94C, and 94BK that inject toner borne on the respective toner bearing members 93Y, 93M, 93C, and 93BK toward the transfer belt 11; and toner controllers 95Y, 95M, 95C, and 95BK having toner through holes that allow the toner injected by the toner injectors 94Y, 94M, 94C, and 94BK to pass through toward the transfer belt 11. The fixing liquid applicator 41 illustrated in FIG. 13 may be that illustrated in FIG. 8 or FIG. 10.

An image forming apparatus according to exemplary aspects of the invention may include only one photoconductor drum. In this case, toner images of each color are sequentially formed and superimposed on one another on the single photoconductor, thus forming a composite full-color toner image.

An image forming apparatus according to exemplary aspects of the invention may produce only monochrome images.

A developer for use in the present invention may be either a two-component developer or a one-component developer. A fixing device for use in the present invention may include either a roller or an endless belt as a fixing member. The roller is advantageous in uniform heating with a simple configuration. The endless belt is advantageous in reduction of electric power consumption.

An image forming apparatus according to exemplary aspects of the invention may be a copier, a printer, a facsimile, or an arbitrary combination thereof.

Additional modifications and variations of the present invention are possible in light of the above teachings. It is therefore to be understood that within the scope of the appended claims the invention may be practiced other than as specifically described herein.

What is claimed is:

1. An image forming apparatus, comprising:

a fixing liquid applicator to apply a fixing liquid to a recording medium, the fixing liquid comprising a plasticizer having a function to swell and soften a toner;

a transfer device to transfer a toner image from a toner image bearing member onto the recording medium to which the fixing liquid is applied while the toner image is in contact with the fixing liquid; and a fixing device having a heater, arranged to fix the toner image on the recording medium by heating the toner image and the fixing liquid to above an environmental temperature, wherein the plasticizer is solid at the environmental temperature, and wherein the plasticizer does not express the swelling and softening function at the environmental temperature but expresses the function at above the environmental temperature.

2. The image forming apparatus according to claim 1, further comprising a fixing liquid application amount controller to control an amount of the fixing liquid applied to the recording medium by the fixing liquid applicator.

3. The image forming apparatus according to claim 2, further comprising a recording medium property detector to detect a property of the recording medium, wherein the fixing liquid application amount controller controls the amount of the fixing liquid applied to the recording medium based on the property detected by the recording medium property detector.

4. The image forming apparatus according to claim 3, wherein the property is smoothness.

5. The image forming apparatus according to claim 1, wherein the fixing liquid applicator includes a fixing liquid discharger to discharge the fixing liquid.

6. The image forming apparatus according to claim 1, wherein the fixing liquid applicator applies the fixing liquid to an area on the recording medium onto which the toner image is to be transferred.

7. The image forming apparatus according to claim 1, wherein the fixing liquid applicator is provided facing a side of the recording medium onto which the toner image is to be transferred, the fixing liquid applicator including an application roller to apply the fixing liquid borne on its surface to the recording medium.

8. The image forming apparatus according to claim 1, wherein the fixing device includes a roller-shaped fixing member to fix the toner image.

9. The image forming apparatus according to claim 1, wherein the toner image bearing member is a photoconductor.

10. The image forming apparatus according to claim 1, wherein the toner image bearing member is an intermediate transfer member onto which the toner image is transferred from a photoconductor.

11. The image forming apparatus according to claim 1, wherein the toner image bearing member is an intermediate transfer member onto which the toner is transferred from a toner bearing member and on which the toner image is formed thereon.

12. The image forming apparatus according to claim 1, wherein the plasticizer expresses the function at temperatures beginning at 40° C. above the environmental temperature.

* * * * *